United States Patent [19]

Schubert et al.

[11] Patent Number: 4,541,478

[45] Date of Patent: Sep. 17, 1985

[54] CONTINUOUS CASTING MOULD

[75] Inventors: Hermann Schubert, Linz; Heinrich Thöne, Stiedelsbach; Richard Kasmader, Auleiten, all of Austria

[73] Assignee: Voest-Alpine Aktiengesellschaft, Linz, Austria

[21] Appl. No.: 423,009

[22] Filed: Sep. 24, 1982

[30] Foreign Application Priority Data

Oct. 9, 1981 [AT] Austria ..... 4341/81

[51] Int. Cl.[4] ..... B22D 11/00

[52] U.S. Cl. ..... 164/440; 164/418; 164/435; 164/443

[58] Field of Search ..... 164/440, 490, 491, 436, 164/435, 443, 444, 418, 485, 486

[56] References Cited

U.S. PATENT DOCUMENTS

| | | | |
|---|---|---|---|
| 3,710,845 | 1/1973 | Burkhardt et al. | 164/436 |
| 3,735,801 | 5/1973 | Burkhardt | 164/436 |
| 4,136,728 | 1/1979 | Schmid | 164/444 |
| 4,368,774 | 1/1983 | Adamec et al. | 164/440 X |

FOREIGN PATENT DOCUMENTS

| | | | |
|---|---|---|---|
| 1758543 | 5/1971 | Fed. Rep. of Germany . | |
| 2445744 | 8/1980 | France . | |
| 761401 | 11/1956 | United Kingdom . | |
| 2023042A | 12/1979 | United Kingdom . | |
| 2024678A | 1/1980 | United Kingdom . | |
| 850284 | 7/1981 | U.S.S.R. | 164/440 |

*Primary Examiner*—Kuang Y. Lin

*Attorney, Agent, or Firm*—Brumbaugh, Graves, Donohue & Raymond

[57] ABSTRACT

A continuous casting mould comprises a first mould part moulding the strand cross section and at least one second mould part arranged after the first part in the strand travelling direction. The second mould part is equipped with wall parts supporting the strand surface and getting into contact therewith. The wall parts are pressable against the strand surface by adjusting means. In order to provide a continuous casting mould which peripherally requires only little space, in which the adjustment force does not depend on the wear of the wall parts, and in which completely uniform adjustment forces and thus always the same wear occur over the length of the wall parts, the adjusting means are arranged so as to be parallel to the longitudinal axis of the strand with their longitudinal axes. Each adjusting means is connected with the run-in and run-out ends of a wall part by an arrangement deflecting the moving direction of the adjusting means directed parallel to the longitudinal axis of the strand in a direction approximately perpendicular to the longitudinal axis of the strand.

7 Claims, 4 Drawing Figures

10
17
20
19
16
18
11
9
15
13
23
31
26
28
25
27
34

III
III
10
36
15
31
32
33
34
27
28
26
25
29
30
12
14
13
19
18
16
17
20
21
22
24
23
35
9
11

CONTINUOUS CASTING MOULD

BACKGROUND OF THE INVENTION

The invention relates to a continuous casting mould, in particular a horizontal continuous casting mould for multiple-strand casting plants, comprising a first mould part moulding the strand cross section and at least one second mould part arranged after the first one in the strand travelling direction, which is equipped with wall parts supporting the strand surface and contacting the same, which wall parts are pressable against the strand surface by adjusting means.

Moulds of this kind are known, for instance, from U.S. Pat. No. 4,136,728 or from Hermann, Hanbuch des Stranggießens, FIG. 430 ("Handbook on Continuous Casting"). The wall parts of the second mould part, the so-called aftercooler, which are pressable to the strand surface with these known moulds are moved towards the strand skin via helical springs or pressure medium cylinders. These helical springs or pressure medium cylinders are arranged so as to be directed with their longitudinal axes approximately perpendicular to the strand surface, at least two springs or pressure medium cylinders being provided per wall part, and wherein at least one spring or pressure medium cylinder engages at the run-in or run-out end of each wall part. Although springs have the advantage of requiring little space, they have the disadvantage that the adjustment forces will change with an increased wear of the wall parts, the wall parts thus contacting the strand surface during casting once with a higher and once with a lower adjustment force.

Furthermore, a lift of the wall parts, such as is suitable, for instance, during threading-in of the starter bar into the mould, is not possible with springs; a special lifting means would have to be provided therefor. Unevenly adjusted springs cause an uneven wear of the wall parts.

Pressure medium cylinders, which enable a simple lift of the wall parts of the aftercooler, however, require a large space behind each wall part of the aftercooler, which is particularly disadvantageous on account of the limited space conditions at the mould. In particular, they cannot be used for multiple-strand casting plants, in which the strands lie closely adjacent.

The invention aims at avoiding these disadvantages and difficulties and has as its object to provide a continuous casting mould of the initially defined kind, which peripherally requires only little space, in which the adjustment force does not depend on the wear of the wall parts, and in which completely uniform adjustment forces and thus always the same wear occur over the length of the wall parts.

SUMMARY OF THE INVENTION

This object is achieved according to the invention in that the adjusting means are arranged so as to be parallel to the longitudinal axis of the strand with their longitudinal axes, and that each adjusting means is connected with the run-in and run-out ends of a wall part by an arrangement deflecting the moving direction of the adjusting means, which is directed parallel to the longitudinal axis of the strand, in the direction approximately perpendicular to the longitudinal axis of the strand.

Suitably, a single adjusting means is provided for each wall part.

According to a preferred embodiment the arrangement deflecting the moving direction is designed as an angle lever articulately connected with one lever arm to the adjusting means and with the second lever arm to the wall part pressable against the strand surface, the angle lever being pivotable about an axis that is stationary relative to the mould.

Advantageously, the lever arm hinged to the wall part is connected with this wall part with play.

In order to ensure an exact position of the wall parts, each of the wall parts pressable against the strand surface is guided on a stationary stand part of the mould by means of a guide perpendicular to the longitudinal axis of the strand, each of the wall parts pressable against the strand surface being mounted on a stationary stand part of the mould by means of an articulation bearing for a better adaptation of the wall parts to the strand surface.

A preferred embodiment is characterized in that the adjusting means are designed as double-acting pressure medium cylinders.

In another preferred embodiment the arrangement deflecting the moving direction is formed by a chain movable in a guide that is arcuately shaped over a quarter circle and consisting of links hinged to each other, the chain being fastened to the wall part on the one hand and to the adjusting means on the other hand.

BRIEF DESCRIPTION OF THE DRAWINGS

The invention will now be explained in more detail with reference to the accompanying drawings, wherein.

DESCRIPTION OF EXEMPLARY EMBODIMENTS

Figure 1:
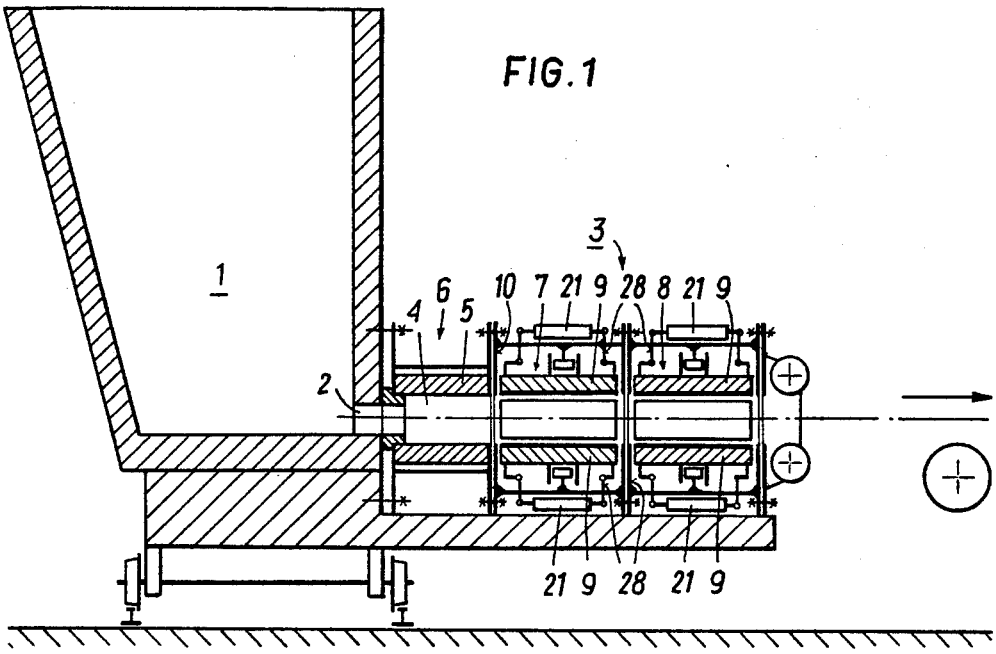
FIG. 1 is a partially sectioned side view of a horizontal continuous casting plant in a schematic illustration.

To a tundish 1 horizontally movable on rails, a continuous casting mould 3 is tightly fastened in the region of its discharge opening 2, which mould, in a known manner, comprises a copper jacket 5 forming the mould cavity 4 and being cooled.

Seen in the strand travelling direction, two further mould parts 7 and 8 are arranged behind this first mould part 6 forming the mould cavity 4, which are each equipped with wall parts 9 supporting the strand surface and contacting with the strand surface.

These two further mould parts 7, 8, which hereafter will be referred to as aftercoolers, are fastened to the first mould part 6 by means of flange plates 10, forming the horizontal continuous casting mould 3 together with the same. The aftercoolers 7, 8 serve to increase the strand skin by intensive cooling of the strand and to prevent a re-melting of the strand skin by the latent solidification heat released in the interior of the strand. Each of the aftercoolers 7, 8 comprises four wall parts 9, hereafter referred to as cooling plates, through which cooling water flows. The cavity 11 of each cooling plate 9, through which the cooling water flows, for this purpose is connected to a hollow frame 13 of the aftercooler, through which the cooling water flows, by means of a connection piece designed as a plain conduit 12. Between the plain conduit 12 and the frame 13 a compensator 14 capable of balancing out the movement of a cooling plate 9 is provided.

A graphite plate 15 is attached to each side of the cooling plates 9 directed to the strand surface, which ensures an optimum heat discharge from the strand on account of its good thermal conductivity. These graphite plates 15 are wear plates, enabling a low friction resistance and thus slight extraction forces for the strand due to their low sliding friction with the strand. To hold each cooling plate 9, a bearing pin 16 is provided per cooling plate on a rigid yoke 17 of the aftercooler, carrying an articulation bearing 18 on whose outer race a guide ring 19 rests. This guide ring 19 enables the sliding of a bearing bush mounted on the cooling plate 9 in the direction of the axis 20 of the bearing pin 16, the axis 20 of the bearing pin being directed approximately normal to the plane of the cooling plate 9. By this construction an automatic alignment of the position of each cooling plate to the strand surface is possible, thus ensuring a total-surface contact of the graphite plate 15 on the strand surface.

Each cooling plate 9 is movable in the direction normal to the strand surface by an adjusting means 21, both towards and away from the strand surface. The adjusting means is designed as a double-acting hydraulic cylinder arranged with its longitudinal axis 22 parallel to the strand axis 23, which is articulately connected, both by its articulation eye 24 arranged on the cylinder and by its articulation eye 25 provided on the piston, with the longer arm 27 each of an angle lever 28 by means of pins 26. Each angle lever 28 is pivotably mounted on the aftercooler by means of a stationary pin 29. The short arm 30 of each angle lever is articulately connected with a console 31 screwed on the cooling plate 9, for the connection of which a further pin 32 serves, which, however, has a play 33 relative to the console 31 in order to ensure a good movability of the angle lever 28. The movement of a cooling plate 9 towards the strand surface is limited by a stop 34 provided on a flange plate 10 of the aftercooler. Each stop 34 coacts with an angle lever 28. When lifting a cooling plate 9, stops of the cooling plate rear side also contact the angle lever 28 so that the movement of the cooling plate 9 also is limited in the direction away from the strand.

The arrangement functions in the following manner: because a separate, single adjusting means 21 is provided for each cooling plate 9, each adjustments means being connected with the run-in end 35 and the run-out end 36 of a wall part via means 28 deflecting the moving direction 22 of this adjusting means 21 (which is directed parallel to the strand longitudinal axis 23) into the direction approximately normal to the strand longitudinal axis 23, a uniform adjustment force is enforced over the total length of the wall part. Thus, a uniform wear of the graphite plates 15 over the length of the wall parts 9 also is ensured.

By adjusting a higher hydraulic pressure in the cylinders 21 of the lower cooling plates, the dead weight of the strand and of the cooling plates 9 can be balanced out thereby attaining, a uniform support of the strand. Instead of the differing hydraulic pressure, springs arranged in the cylinders 21 or on the lever mechanism 28 could be used.

Suitably, the pressure in the cylinders 21 is (advantageously automatically) adjusted to an optimum value in accordance with the ferrostatic pressure in the liquid phase of the strand and other casting parameters, such as, for instance, the extraction speed and the reciprocation stroke of the strand, so that the supporting and cooling effects of the cooling plates 9 are optimized at a friction as low as possible.

The arrangement of the hydraulic cylinders 21 parallel to the longitudinal axis 23 of the strand brings about extremely favorable space conditions, and it is possible to use the continuous casting mould 3 according to the invention also for multiple-strand continuous casting plants, wherein the strands can be guided closely adjacent.

By the arrangement according to the invention it is possible to lift the cooling plates 9 from the strand, which is advantageous when threading the starter bar into the mould. The sensitive graphite plates are thereby preserved from damage during this procedure.

Figure 4:
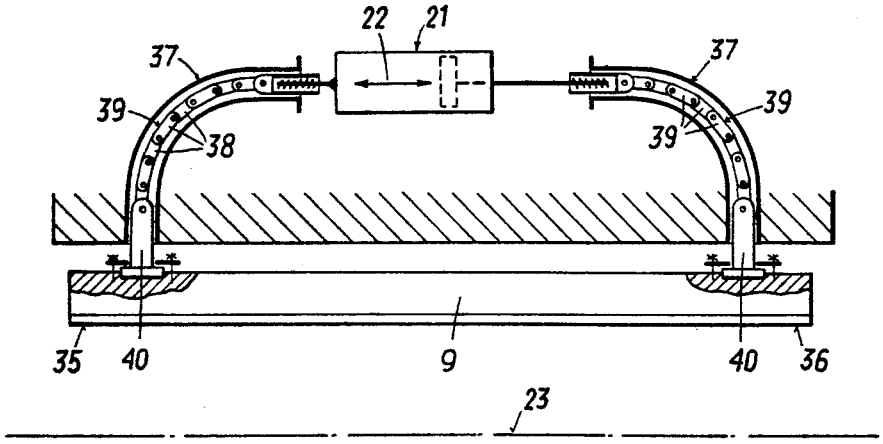
FIG. 4 is a detail of a further embodiment.
Figure 3:
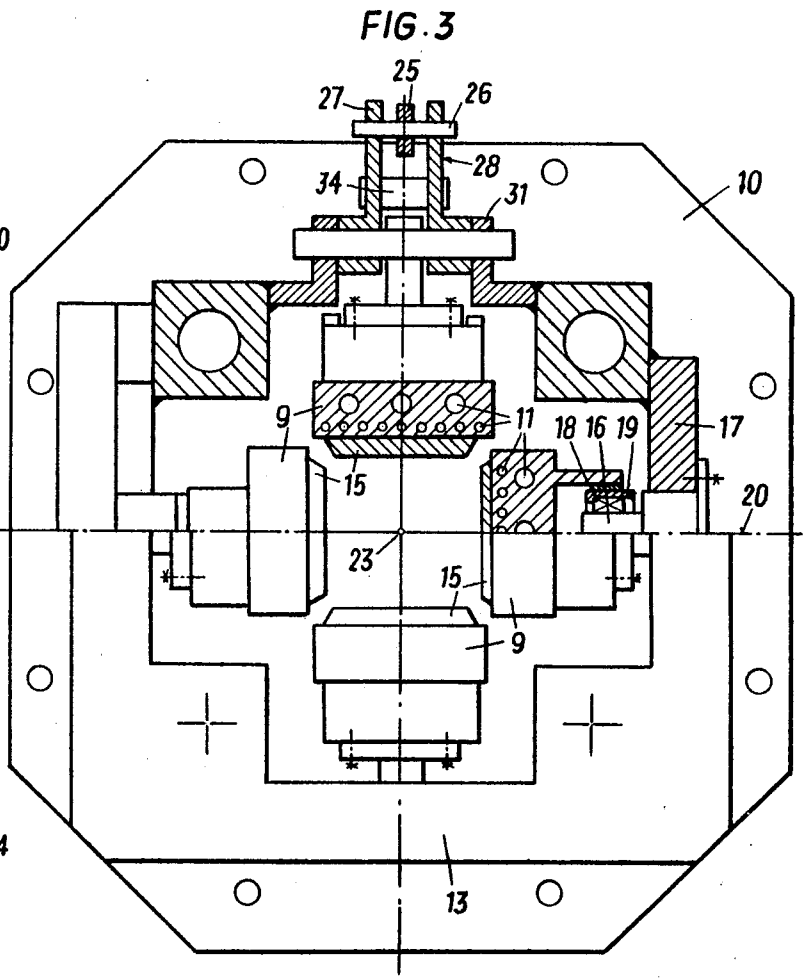
FIG. 3 is a view according to the arrow III of FIG. 2 and a section along line III—III of FIG. 2, respectively.
Figure 2:
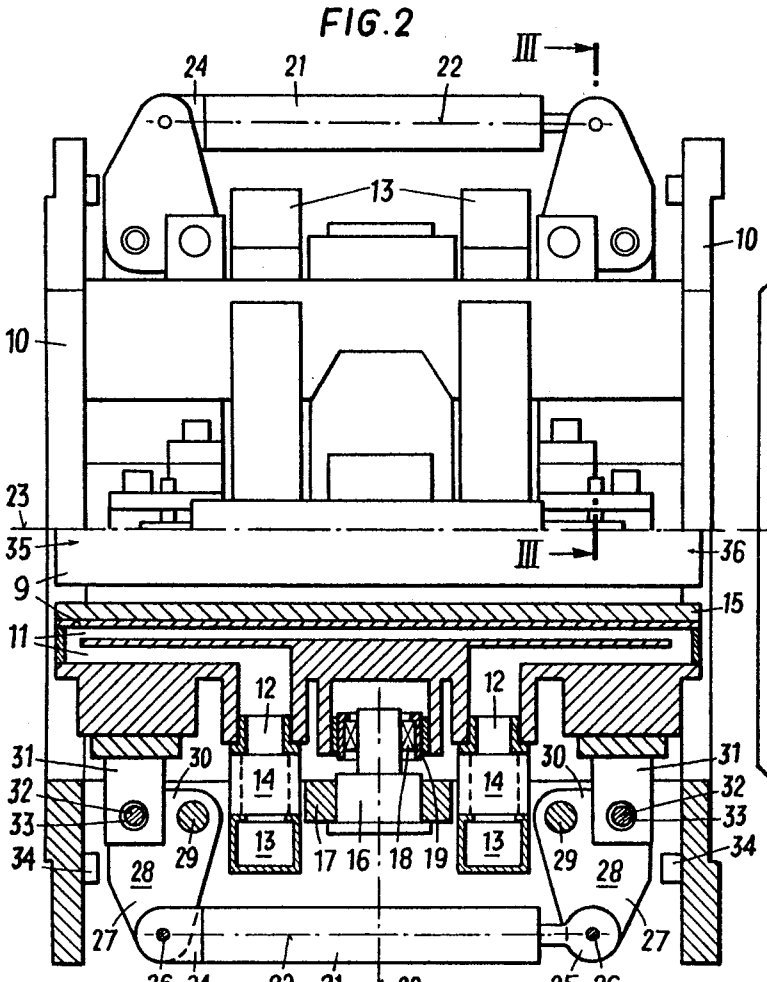
FIG. 2 illustrates an aftercooler of the continuous casting mould on an enlarged scale, partially sectioned.

In FIG. 4 a further embodiment is illustrated, in which the arrangement deflecting the moving direction of a cylinder is formed by an arcuate guide 37 extending at a central angle of about 90° and rigidly mounted on the aftercooler, within which guide a chain 39 formed by links 38 hinged to each other is guided. The double-acting cylinder 21 is hinged to such a chain 39 on the one hand with its cylinder and on the other hand with its piston. To the ends of the chain 39 supporting members 40 are hinged, which are fastened on the run-in end 35 and run-out end 36 of each wall part 9 of the aftercooler.

What we claim is:

1. In a continuous casting mould for casting a strand, in particular a horizontal continuous casting mould for a multiple-strand casting plant, and of the type including a first mould part moulding the cross section of said strand, at least one second mould part arranged behind said first mould part in the travelling direction of said strand along a strand path, a plurality of wall parts provided in said second mould part each supporting a surface of said strand by contacting the same, each of said wall parts comprising a run-in end and a run-out end, and adjusting means for pressing said wall parts against said strand surface, the improvement wherein each said adjusting means comprises double-acting pressure medium cylinder means disposed with its longitudinal axis extending parallel to the longitudinal axis of the strand path, said pressure medium cylinder means having a piston and a cylinder, said adjusting means further comprising deflection means articulately connecting said piston to one end of said wall part and said cylinder to the other end of said wall part, whereby the action of said pressure medium cylinder means is deflected by said deflection means from the direction parallel to the longitudinal axis of said strand path into a direction approximately perpendicular to the longitudinal axis of said strand path, thereby providing a uniform adjustment force over the length of said wall part.

2. A mould as set forth in claim 1, wherein a separate adjusting means is provided for each of said wall parts.

3. In a continuous casting mould for casting a strand, in particular a horizontal continuous casting mould for a multiple-strand casting plant, and of the type including a first mould part moulding the cross section of said strand, at least one second mould part arranged behind said first mould part in the travelling direction of said strand along a strand path, a plurality of wall parts provided in said second mould part each supporting a surface of said strand by contacting the same, each of said wall parts comprising a run-in end and run-out end, and adjusting means for pressing said wall parts against said strand surface, the improvement wherein each said adjusting means comprises double-acting pressure medium cylinder means disposed with its longitudinal axis extending parallel to the longitudinal axis of the strand path, said pressure medium cylinder means having a piston and a cylinder, said adjusting means further comprising deflection means articulately connecting said piston to one end of said wall part and said cylinder to the other end of said wall part, each of said deflection means comprising an angle lever pivotable about an axis which is stationary relative to said mould and comprising a first lever arm articulately connected to one of said piston and cylinder and a second lever arm articulately connected to a wall part at one of said run-in and run-out ends, whereby the action of said adjusting means is deflected from the direction parallel to the longitudinal axis of said strand path into a direction approximately perpendicular to the longitudinal axis of said strand path, thereby providing a uniform adjustment force over the length of said wall part.

4. A mould as set forth in claim 3, wherein said second lever arm hinged to said wall part is connected therewith with play.

5. A mould as set forth in claim 1, 2 or 4, further comprising a stationary stand part provided at said mould and a guide for guiding each of said wall parts pressable against said strand surface on said stationary strand part perpendicular to the longitudinal axis of said strand.

6. A mould as set forth in claim 1, 2 or 4, further comprising a stationary strand part provided at said mould and an articulation bearing for journaling each of said wall parts pressable against said strand surface on said stationary strand part.

7. In a continuous casting mould for casting a strand, in particular a horizontal continuous casting mould for a multiple-strand casting plant, and of the type including a first mould part moulding the cross section of said strand, at least one second mould part arranged behind said first mould part in the travelling direction of said strand along a strand path, a plurality of wall parts provided in said second mould part each supporting a surface of said strand by contacting the same, each of said wall parts comprising a run-in end and a run-out end, and adjusting means for pressing said wall parts against said strand surface, the improvement wherein each said adjusting means comprises double-acting pressure medium cylinder means disposed with its longitudinal axis extending parallel to the longitudinal axis of the strand path, said pressure medium cylinder means having a piston and a cylinder, said adjusting means further comprising deflection means articulately connecting said piston to one end of said wall part and said cylinder to the other end of said wall part, each of said deflection means comprising a chain of links hinged to each other and movable over an arcuate guide extending over a quarter circle between one of said piston and cylinder and one end of said wall parts, whereby the action of said adjusting means is deflected by said deflection means from the direction parallel to the longitudinal means from the direction parallel to the longitudinal axis of said strand path into a direction approximately perpendicular to the longitudinal axis of said strand path, thereby providing a uniform adjustment force over the length of said wall part.

* * * * *

UNITED STATES PATENT AND TRADEMARK OFFICE

CERTIFICATE OF CORRECTION

PATENT NO. : 4,541,478

DATED : Sep. 17, 1985

INVENTOR(S) : Schubert et al.

It is certified that error appears in the above-identified patent and that said Letters Patent is hereby corrected as shown below:

Col. 1, line 15, "Hanbuch" should read --Handbuch--;

Col. 2, line 52, delete "with";

Col. 3, line 47, "adjustments" should read --adjustment--;

line 49, after "part" insert --9--;

line 60, "out thereby attaining," should read --out, thereby attaining--;

Col. 5, line 33, "strand" should read --stand--;

Col. 6, line 2, "strand" should read --stand--; and

Signed and Sealed this

*Eleventh* Day of *February 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,541,478

DATED : September 17, 1985

INVENTOR(S) : Hermann Schubert et al

It is certified that error appears in the above-identified patent and that said Letters Patent is hereby corrected as shown below:

Column 6, line 26, "parts" should read -- part --.

Signed and Sealed this

*Second* Day of *September 1986*

[SEAL]

*Attest:*

DONALD J. QUIGG

*Attesting Officer*

*Commissioner of Patents and Trademarks*